US010570582B2

(12) United States Patent
Berry et al.

(10) Patent No.: US 10,570,582 B2
(45) Date of Patent: Feb. 25, 2020

(54) SYSTEM AND METHOD FOR OPERATING A MATERIAL-HANDLING MACHINE

(71) Applicant: Caterpillar Inc., Peoria, IL (US)

(72) Inventors: Jeffrey K. Berry, Yorkville, IL (US); Qi Wang, Pittsburgh, PA (US); Joseph E. Forcash, Zelienope, PA (US); Ken L. Stratton, Dunlap, IL (US); Paul E. Rybski, Pittsburgh, PA (US)

(73) Assignee: Caterpillar Inc., Peoria, IL (US)

( * ) Notice: Subject to any disclaimer, the term of this patent is extended or adjusted under 35 U.S.C. 154(b) by 544 days.

(21) Appl. No.: 15/360,980

(22) Filed: Nov. 23, 2016

(65) Prior Publication Data

US 2018/0142441 A1 May 24, 2018

(51) Int. Cl.

| | |
|---|---|
| ***E02F 3/43*** | (2006.01) |
| ***E02F 9/26*** | (2006.01) |
| *E02F 3/28* | (2006.01) |

(52) U.S. Cl.

CPC ..... *E02F 3/431* (2013.01); *E02F 3/434* (2013.01); *E02F 9/262* (2013.01); *E02F 9/265* (2013.01); *E02F 3/283* (2013.01)

(58) Field of Classification Search

CPC . E02F 3/431; E02F 9/262; E02F 3/434; E02F 9/265; E02F 3/283

See application file for complete search history.

(56) References Cited

U.S. PATENT DOCUMENTS

| | | | |
|---|---|---|---|
| 5,996,703 | A | 12/1999 | Yamamoto et al. |
| 6,076,030 | A | 6/2000 | Rowe |

(Continued)

FOREIGN PATENT DOCUMENTS

| | | | |
|---|---|---|---|
| AU | 200016446 | A | 6/2000 |
| JP | 2008248523 | A | 10/2008 |

(Continued)

OTHER PUBLICATIONS

Dirt Ninja "Cat 918M Wheel Loader Loading Dump Truce", see attached PDFs "Height 1" and "Height 2" <https://www.youtube.com/watch?v=fiHQKuwZwIE>.*

(Continued)

*Primary Examiner* — Nadeem Odeh
*Assistant Examiner* — Michael V Kerrigan
(74) *Attorney, Agent, or Firm* — Hibshman Claim Construction PLLC

(57) ABSTRACT

A machine includes a power generation system; a propulsion system; a work implement coupled to a body of the machine via a linkage that includes at least one actuator; a perception system configured to generate a signal that is indicative of a position of the machine relative to a material receptacle; and a controller operatively coupled to the perception system, the propulsion system, the power generation system, and the at least one actuator. The controller is configured to receive the signal from the perception system, determine a location of the work implement relative to the material receptacle based at least in part on the signal from the perception system, and actuate at least one of the propulsion system, the power generation system, and the at least one actuator based on the determined location of the work implement relative to the material receptacle.

20 Claims, 11 Drawing Sheets

(56) References Cited

U.S. PATENT DOCUMENTS

| | | | | |
|---|---|---|---|---|
| 6,247,538 | B1 | 6/2001 | Takeda et al. | |
| 8,036,797 | B2 | 10/2011 | Johnson et al. | |
| 8,386,134 | B2 | 2/2013 | Morey et al. | |
| 2006/0276948 | A1 | 12/2006 | Toda | |
| 2010/0052831 | A1 | 3/2010 | Takano | |
| 2010/0324788 | A1 | 12/2010 | Toda | |
| 2011/0231070 | A1 | 9/2011 | Toda | |
| 2011/0276238 | A1 | 11/2011 | Toda | |
| 2013/0041561 | A1 | 2/2013 | Asami et al. | |
| 2013/0073151 | A1 | 3/2013 | Wada et al. | |
| 2013/0118160 | A1 | 5/2013 | Toda | |
| 2015/0004566 | A1 | 1/2015 | Bomer et al. | |
| 2015/0004572 | A1 | 1/2015 | Bomer et al. | |
| 2015/0004574 | A1 | 1/2015 | Bomer et al. | |
| 2018/0080193 | A1* | 3/2018 | Myers | E02F 3/34 |
| 2019/0093311 | A1* | 3/2019 | Naito | E02F 9/2033 |

FOREIGN PATENT DOCUMENTS

| | | | |
|---|---|---|---|
| JP | 2009052924 | A | 3/2009 |
| WO | WO2010052831 | A1 | 5/2010 |
| WO | WO2015129932 | A1 | 9/2015 |

OTHER PUBLICATIONS

Ghabcheloo et al., Autonomous Motion Control of a Wheel Loader, Paper No. DSCC2009-2653, pp. 427-434, ASME 2009 Dynamic Systems and Control Conference, vol. 2, Hollywood, California, USA, Oct. 12-14, 2009.

Kanai et al., Autonomous scooping of a rock pile by a wheel loader using disturbance observer, pp. 472-475, ISARC (2006).

* cited by examiner

SYSTEM AND METHOD FOR OPERATING A MATERIAL-HANDLING MACHINE

TECHNICAL FIELD

The present disclosure relates generally to a material-handling machine and, more particularly, to a system and a method for operating a material-handling machine.

BACKGROUND

Material-handling machines, such as excavators, wheel loaders, forklifts, and the like, may be used to transport materials about a worksite. An operator may provide control inputs that cause an implement of the machine to perform a sequence of operations that complete a work cycle. The sequence of operations may include loading the implement with material, lifting the implement and material, transporting the material across the worksite via the implement, and unloading or dumping the material from the implement.

US Patent Application Publication Number 2015/0077557 (hereinafter "the '557 publication"), purports to describe a system which senses a target on a towed implement and automatically controls the steering and movement of a vehicle to align the vehicle with the towed implement which is to be coupled to the vehicle, such as a wagon or trailer. According to the '557 publication, a towing vehicle, such as an agricultural tractor, has a conventional hitch and/or a drawbar for coupling to an implement, and a pair of cameras that are mounted on a rear upper portion of the towing vehicle. A target is mounted on the towed implement so as to be viewable from the direction of the vehicle.

The vehicle of the '557 publication further includes and electronic control unit (ECU) that processes the images from the cameras and generates tractor movement commands that cause the vehicle to move to a position that permits the implement to be coupled to the tractor. However, the vehicle and implement alignment system of the '557 publication may not benefit other cycles performed by other machines, such as cycles of material-handling machines that benefit from movement of the machine relative to a worksite, coordinated with movement of a machine implement relative to the machine. Accordingly, there exists a need for improved material-handling machine operating systems and methods to address the aforementioned challenges and/or other problems in the art.

It will be appreciated that this background description has been created to aid the reader, and is not a concession that any of the indicated problems or challenges were themselves previously known in the art.

SUMMARY

According to an aspect of the disclosure, a machine includes a power generation system, a propulsion system operatively coupled to the power generation system for transmission of power therebetween and configured to propel the machine over a work surface, and a work implement operatively coupled to the power generation system for transmission of power therebetween and coupled to a body of the machine via a linkage that includes at least one actuator; and a system for controlling the machine comprises a perception system configured to generate a signal that is indicative of a position of the machine relative to a material receptacle; and a controller operatively coupled to the perception system, the propulsion system, the power generation system, and the at least one actuator. The controller is configured to receive the signal from the perception system, determine a location of the work implement relative to the material receptacle based at least in part on the signal from the perception system, and actuate at least one of the propulsion system, the power generation system, and the at least one actuator based on the determined location of the work implement relative to the material receptacle to transfer a material from the work implement to the material receptacle while avoiding contact between the work implement and the material receptacle.

According to another aspect of the disclosure, a machine includes a power generation system, a propulsion system operatively coupled to the power generation system for transfer of power therebetween and configured to propel the machine over a work surface, a work implement operatively coupled to the power generation system for transfer of power therebetween and coupled to a body of the machine via a linkage that includes at least one actuator, and a perception system configured to generate a signal that is indicative of a position of the machine relative to a material receptacle; and a method for controlling the machine comprises receiving within a controller the signal from the perception system; determining, via the controller, a location of the work implement relative to the material receptacle based at least in part on the signal from the perception system, and actuating, via the controller, at least one of the propulsion system, the power generation system, and the at least one actuator based on the determined location of the work implement relative to the material receptacle to transfer a material from the work implement to the material receptacle while avoiding contact between the work implement and the material receptacle.

According to another aspect of the disclosure, a machine comprises a power generation system, a propulsion system operatively coupled to the power generation system for transfer of power therebetween and configured to propel the machine over a work surface; a work implement operatively coupled to the power generation system for transfer of power therebetween and coupled to a body of the machine via a linkage that includes at least one actuator; a perception system configured to generate a signal that is indicative of a position of the machine relative to a material receptacle; and a controller operatively coupled to the perception system, the propulsion system, and the at least one actuator. The controller is configured to receive the signal from the perception system, determine a location of the work implement relative to the material receptacle based at least in part on the signal from the perception system, and actuate at least one of the propulsion system, the power generation system and the at least one actuator based on the determined location of the work implement relative to the material receptacle to transfer a material from the work implement to the material receptacle while avoiding contact between the work implement and the material receptacle.

DETAILED DESCRIPTION

Aspects of the disclosure will now be described in detail with reference to the drawings, wherein like reference numbers refer to like elements throughout, unless specified otherwise.

Figure 1:
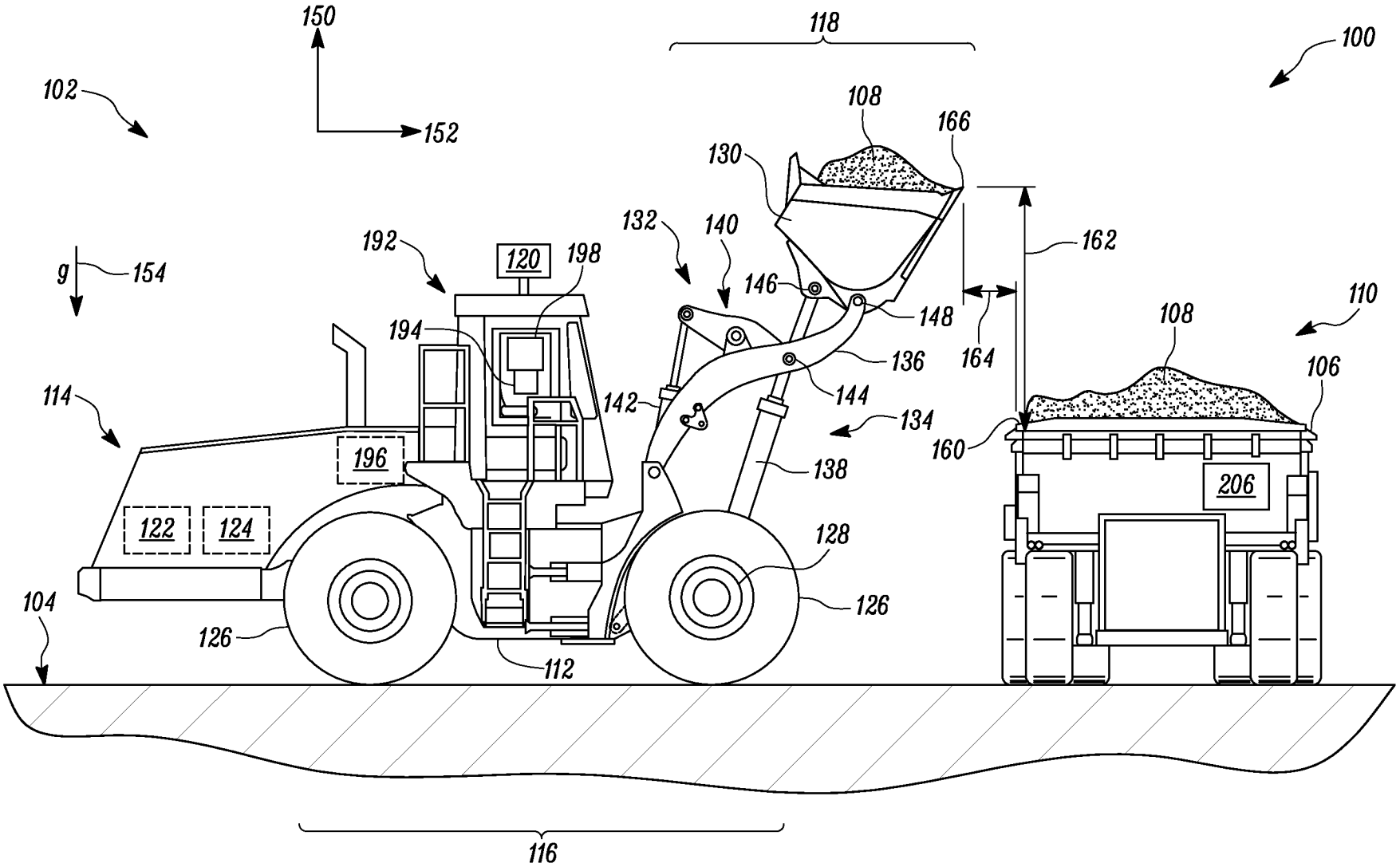
FIG. 1 is a side view of a worksite, according to an aspect of the disclosure.

FIG. 1 illustrates a worksite 100, including a material-handling machine 102 disposed on a work surface 104, a material receptacle 106 disposed on the work surface 104, and a work material 108. The machine 102 may be any material-handling machine that performs an operation associated with an industry such as mining, construction, farming, transportation, forestry, or any other industry known in the art. For example, the material-handling machine 102 may be an earth-moving machine, such as a wheel loader, an excavator, or a backhoe; a forest machine; a forklift; or other material-handling machine known in the art. The material receptacle 106 may be a stationary material receptacle such as a hopper, a bin, or a shelf that is fixed to the worksite 100; a mobile receptacle such as a bed of a dump truck, a flatbed trailer, or a logging truck; or any other material receptacle known in the art. The work material 108 may include an earthen material on a mining or construction site; a material disposed on a pallet in a warehouse worksite; logs on a logging worksite; refuse on a landfill worksite; or any other work material known in the art. In the non-limiting aspect illustrated in FIG. 1, the material-handling machine 102 is a wheel loader, and the material receptacle 106 is the bed of a dump truck 110.

The machine 102 illustrated in FIG. 1 includes a body 112, a power generation system 114 coupled to the body 112, a propulsion system 116 coupled to the body 112, an implement system 118 coupled to the body 112, and a perception system 120 coupled to the body 112. The power generation system 114 may include a power source 122 and at least one transmission mechanism 124. The power source 122 may convert stored energy, such as chemical energy or electrical energy, into mechanical shaft power. For example, the power source 122 may include an internal combustion engine, such as a spark-ignition engine, a compression ignition engine, or a gas turbine; an electric motor; combinations thereof; or any other power source known in the art.

The at least one transmission mechanism 124 is operatively coupled to the power source 122 and configured to convert shaft power from the power source 122 into another form of power, such as hydraulic power, pneumatic power, or electric power; modify an attribute of shaft power from the power source 122, such as rotational speed or torque of the shaft power; or combinations thereof. The at least one transmission mechanism 124 may include a gear train, a torque converter, a drive shaft, a clutch, a belt-and-pulley system, a chain-and-sprocket system, a hydraulic pump, a pneumatic compressor, an electric generator, combinations thereof, or any other transmission mechanism known in the art.

The propulsion system 116 includes at least one propulsion device 126 and at least one braking device 128. The at least one propulsion device 126 is operatively coupled to the power source 122 via the at least one transmission mechanism 124 for transmission of shaft power therebetween, and configured to effect movement of the body 112 of the machine 102 relative to the work surface 104. For example, the at least one propulsion device 126 may be operatively coupled to the power source 122 via a gear box for transmission of shaft power therebetween, or the at least one propulsion device 126 may be operatively coupled to an electric motor that receives electric power from the power source 122. The at least one propulsion device 126 may include a wheel, a track belt, combinations thereof, or any other propulsion device known in the art.

The at least one braking device 128 is configured to absorb kinetic energy from the at least one propulsion device 126, thereby retarding motion of the body 112 of the machine 102 over the work surface 104. The at least one braking device 128 may store or dissipate the kinetic energy absorbed from the at least one propulsion device 126. For example, the at least one braking device 128 may absorb and dissipate kinetic energy from the at least one propulsion device 126 as heat generated by friction between two surfaces; absorb kinetic energy from the at least one propulsion device 126, convert the kinetic energy to electrical energy through an electric generator, and store the electrical energy in a battery; or combinations thereof.

The implement system 118 includes a work implement 130 that is coupled to the body 112 via a linkage 132, and at least one actuator 134 coupled to the linkage 132 that is configured to effect relative motion between the work implement 130 and the body 112. The work implement may be a loader bucket, an excavator bucket, a forklift fork, a log grappler, or any other work implement known in the art of material handling. The work implement 130 illustrated in FIG. 1 is a loader bucket.

The linkage 132 illustrated in FIG. 1 includes a lift arm 136, a lift actuator 138, a tilt linkage 140, and a tilt actuator 142. The lift actuator 138 is operatively coupled between the body 112 and the lift arm 136 at a first pivot joint 144, and is configured to move the implement 130 relative to the body 112 in at least the vertical direction 150. The tilt actuator 142 is operatively coupled between the body 112 and the implement 130 at a second pivot joint 146 via the tilt linkage 140, and is configured to rotate the implement 130 about a third pivot joint 148 through a distal end of the lift arm 136.

According to an aspect of the disclosure, the lift actuator 138, the tilt actuator 142, or both, may be linear hydraulic cylinders that are coupled to the power source 122 via one or more hydraulic pumps in the at least one transmission mechanism 124. However, it will be appreciated that the lift actuator 138 and the tilt actuator 142 may comprise other types of actuators know in the art to suit a particular application.

According to an aspect of the disclosure, the vertical direction 150 is substantially perpendicular to the work surface 104, and the forward direction 152 is perpendicular to the vertical direction 150 along a direction of forward travel of the machine 102. "Substantially perpendicular" may include deviations of +/−3 degrees from perpendicular, for example. It will be appreciated that the vertical direction 150, the forward direction 152, or both, may alternatively be defined with respect to a gravity direction 154. It will be further appreciated that the work surface 104 may include portions with different inclines or slopes with respect to the gravity direction 154, and that the vertical direction 150 may be determined relative to a portion of the work surface that is occupied by the machine 102, a portion of the work surface that is occupied by the material receptacle 106, combinations thereof, or another portion of the work surface.

The perception system 120 may include at least one perception device 158, such as a monocular camera, a stereo camera, a Light Detection and Ranging (LiDAR) system, a Global Positioning System (GPS) unit, combinations thereof, or any other perception device known in the art. It will be appreciated that the perception system 120 may be mounted on the machine 102, or alternatively be mounted remotely from the machine 102 but in data communication with the machine 102. According to an aspect of the disclosure, the at least one perception device 158 does not include a GPS unit.

The perception system 120 is configured to determine the locations of one or more points on the machine 102 relative to points on the material receptacle 106, angular alignment of a plane defined by the machine 102 relative to a plane defined by the material receptacle 106, or combinations thereof. For example, the perception system 120 may be configured to identify a top edge 160 of the material receptacle 106, and determine a vertical distance 162 along the vertical direction 150 and a horizontal distance 164 along the forward direction 152 from the top edge 160 of the material receptacle 106 to a leading edge 166 of the work implement 130.

Figure 2:
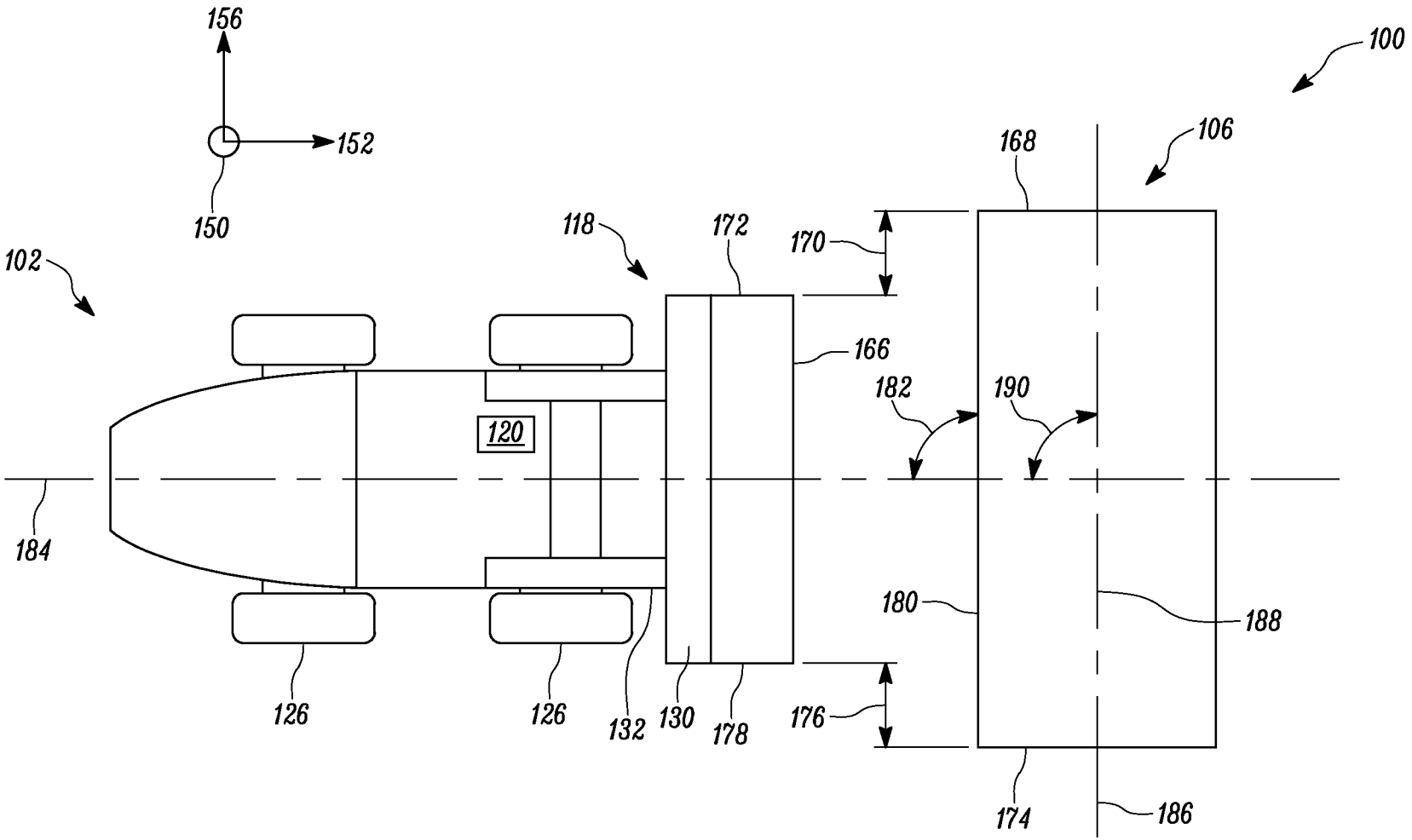
FIG. 2 is a plan view of a worksite, according to an aspect of the disclosure.

Alternatively or additionally, as shown in the plan view of a worksite 100 illustrated in FIG. 2, the perception system 120 may be configured to determine a location of the machine 102 relative to the material receptacle 106 in a plane defined by the forward direction 152 and a transverse direction 156, where the transverse direction 156 may be perpendicular to the forward direction 152, the vertical direction 150, or both. For example, the perception system 120 may be configured to identify a left edge 168 of the material receptacle 106 and determine a distance 170 from the left edge 168 of the material receptacle 106 to a left edge 172 of the work implement 130 along the transverse direction 156; identify a right edge 174 of the material receptacle 106 and determine a distance 176 from the right edge 174 of the material receptacle 106 to a right edge 178 of the work implement 130 along the transverse direction 156; or both.

Furthermore, the perception system 120 may be configured to identify a proximate wall 180 of the material receptacle 106, and determine an angle 182 defined between a plane of the proximate wall 180 and a reference plane 184 of the machine 102 defined by the forward direction 152 and the vertical direction 150. Alternatively or additionally, the perception system 120 may be configured to identify a reference plane 186 of the material receptacle 106 defined by a longitudinal axis 188 of the material receptacle 106 and the vertical direction 150, and determine an angle 190 defined by the reference plane 186 of the material receptacle 106 and the reference plane 184 of the machine 102. Moreover, it will be appreciated that the perception system 120 may be configured to determine the location of the machine 102 relative to the material receptacle 106 according to other spatial metrics.

Returning to FIG. 1, the body 112 of the machine 102 may define an operator cab 192 that includes at least one operator input device 194 for receiving control inputs from an operator and a display 198 for conveying control feedback and other information regarding the operational state of the machine 102 to the operator. The display 198 may provide feedback to an operator of the machine 102 in the form of visual feedback, audible feedback, tactile or haptic feedback, combinations thereof, or any other form of feedback known in the art.

The at least one operator input device 194 may include a joystick, a button, a touchscreen, a keyboard, a mouse, a dial, a slider, a microphone, a valve, a lever, combinations thereof, or any other user input device known in the art. It will be appreciated that the at least one operator input device 194 may receive control inputs from onboard the machine 102, off-board the machine 102 via wired or wireless telemetry, or both. Further, it will be appreciated that the at least one operator input device 194 may generate an actuating signal to control operation of an aspect of any one of the power source 122, the at least one transmission mechanism 124, the at least one braking device 128, the perception system 120, the propulsion system 116, the work implement system 118, or combinations thereof.

The machine 102 further includes a controller 196 that is operatively coupled to the at least one operator input device 194, the power generation system 114, the propulsion system 116, the implement system 118, the perception system 120, combinations thereof, or any other system of the machine 102 that could benefit from receipt of control signals. Thus, the controller 196 may be any purpose-built processor for effecting control of any operational aspect of the machine 102.

It will be appreciated that the controller 196 may be embodied in a single housing, or a plurality of housings distributed onboard the machine 102, off-board the machine 102, or both. Further, the controller 196 may include power electronics, preprogrammed logic circuits, data processing circuits, volatile memory, non-volatile memory, software, firmware, input/output processing circuits, combinations thereof, or any other controller structures known in the art.

Figure 3:
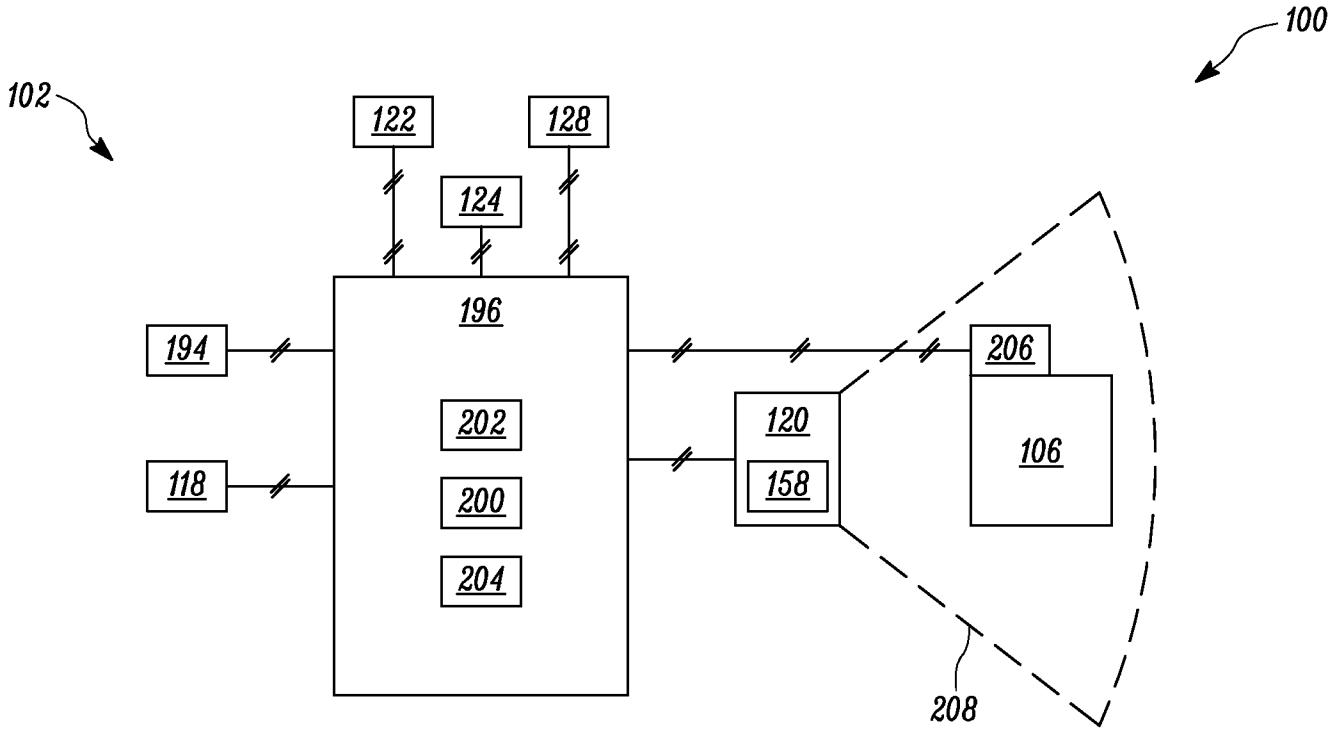
FIG. 3 is a block diagram of a worksite, according to an aspect of the disclosure.

FIG. 3 shows a control block diagram for a worksite 100, according to an aspect of the disclosure. As discussed previously, the controller 196 may be operatively coupled to the power source 122, the at least one transmission mechanism 124, the work implement system 118, the at least one braking device 128, the perception system 120, the at least one operator input device 194, or combinations thereof. The operative coupling with the controller 196 may include communication with actuators, sensors, or any other structure known in the art to benefit the control of the machine 102.

The communication from the perception system 120 to the controller 196 may include encoded signals that are indicative of a position of the machine 102 relative to the material receptacle 106, a position of the machine 102 relative to the work surface 104, or both. Furthermore, the controller 196 may send actuating signals to the perception system 120 to trigger a scan or data collection, or otherwise tailor operation of the perception system 120.

The material receptacle 106 may optionally have a GPS unit 206 associated therewith, that is operatively coupled to the controller 196 for transmitting a signal that is indicative of a location of the material receptacle 106 relative to the work surface 104. Accordingly, the controller 196 may determine a location of the machine 102 relative to the material receptacle 106 based on a difference between a location of the machine 102 relative to the work surface 104 and a location of the material receptacle 106 relative to the work surface 104. Such an alternate determination of the location of the machine 102 relative to the material receptacle 106 may be useful, for example, when the material receptacle 106 is outside of a zone of detection 208 of other perception devices 158, such as cameras or LiDAR.

The communication from the power source 122 to the controller 196 may include signals indicative of a rotational speed of the power source 122, or any other operational state of the power source 122 known in the art. The communication from the controller 196 to the power source 122 may include actuating signals for setting a target rotational speed, effecting a target fuel injection schedule, combinations thereof, or any other engine actuation signal known in the art.

The communication from the at least one transmission mechanism 124 to the controller 196 may include signals indicative of output shaft speeds, hydraulic supply pressures, electric supply voltages, or combinations thereof. Furthermore, the controller 196 may send actuating signals to the at least one transmission mechanism 124 to engage or disengage a clutch, change a gear ratio, vary a hydraulic pump displacement, combinations thereof, or any other transmission actuation signal known in the art. The controller 196 may be configured to determine a land speed of the body 112 of the machine 102 relative to the work surface 104 based on signals indicative of output shaft speeds from the at least one transmission mechanism 124 and information regarding gear ratios, tire diameters, and the like, for the machine 102.

The communication from the work implement system 118 to the controller 196 may include signals indicative of hydraulic pressure, hydraulic flow rate, linear hydraulic cylinder velocity, work implement 130 velocity state, work implement 130 system positional state, or combinations thereof, associated with the lift actuator 138, the tilt actuator 142, or both. In turn, the controller 196 may be configured to determine a position, orientation, velocity, or combinations thereof, associated with points on the work implement 130, the lift arm 136, the tilt linkage 140, or combinations thereof, based on sensor signals from the work implement system 118 and information regarding the geometry of the work implement system 118. Furthermore, the controller 196 may send actuating signals to the work implement system 118 to effect a desired direction of motion, velocity of motion, force, or combination thereof, associated with the lift actuator 138, the tilt actuator 142, or both.

The controller 196 may send actuating signals to the at least one braking device 128 to modulate the retarding force applied by the at least one braking device 128 to elements of the propulsion system 116, including disengagement of the at least one braking device 128 from applying any substantial retarding force to an element of the propulsion system 116. According to an aspect of the disclosure, the at least one braking device 128 is a service brake of the machine 102.

Control signals output from the controller 196 to various actuators of the machine 102 may be based on control command signals generated by the at least one operator input device 194; logic encoded in a memory 200 and executed in a processor 202 of the controller 196, or combinations thereof. Thus, operation of the machine 102 may be effected by completely manual control inputs from the at least one operator input device 194; completely automatic control inputs from the processor 202; manual control inputs from the at least one operator input device 194 that are modified by logical instructions executed within the processor 202; or combinations thereof.

The controller 196 may include a cycle counter unit 204, which may detect loading and unloading cycles of the implement 130, and index a counter in response to detection of completing a loading and unloading cycle of the implement 130. The loading and unloading cycles may be detected, at least in part, by pattern recognition from operating data obtained from the work implement system 118, the at least one transmission mechanism 124, the propulsion system 116, or combinations thereof.

According to an aspect of the disclosure, the controller 196 may estimate the amount of material 108 delivered by the machine 102 according to a number of loading and unloading cycles. According to another aspect of the disclosure, the controller 196 may estimate the remaining capacity in a material receptacle 106 to receive more material 108 based on a number of loading and unloading cycles performed with that material receptacle 106 and the overall capacity (weight or volume, for example) of the material receptacle 106.

INDUSTRIAL APPLICABILITY

The present disclosure is generally applicable to material-handling machines and operation of material-handling machines for loading a material into a material receptacle.

Operations for unloading a material 108 from an implement 130 of a material-handling machine 102 pose challenges with respect to operator skill, fatigue, and visibility of the unloading zone. Indeed, unloading operations may require the operator to maintain precise control of the implement in close proximity to other worksite structures, such as a material receptacle 106, throughout repetitive unloading cycles.

Less experienced operators may cause unintended contact between the material-handling machine 102 and the material receptacle 106, which may cause damage to the material-handling machine 102 or the material receptacle 106, and which may result in less than optimum productivity. Furthermore, the repetitive nature of the loading and unloading cycles may cause operator fatigue, which may also cause less than optimum productivity.

Situations where the operator has limited visibility of the unloading zone adjacent the material receptacle 106 may also be prone to unintended contact between the material-handling machine 102 and the material receptacle 106, reduced productivity, or both. Although assistance from a second operator, located outside the operator cab 192, may promote accuracy of unloading operations by conveying instructions to an operator within the operator cab 192, employing a second operator to aid the unloading operations may unduly burden the cost of the operation.

Systems and methods according to aspects of the present disclosure alleviate the aforementioned challenges with unloading operations by determining the location of the implement 130 of the material-handling machine 102 relative to a material receptacle 106, and then by having a controller 196 fully automate the unloading operation, or intervene to override or modify manual control inputs from an operator during the unloading operation.

Figure 4:
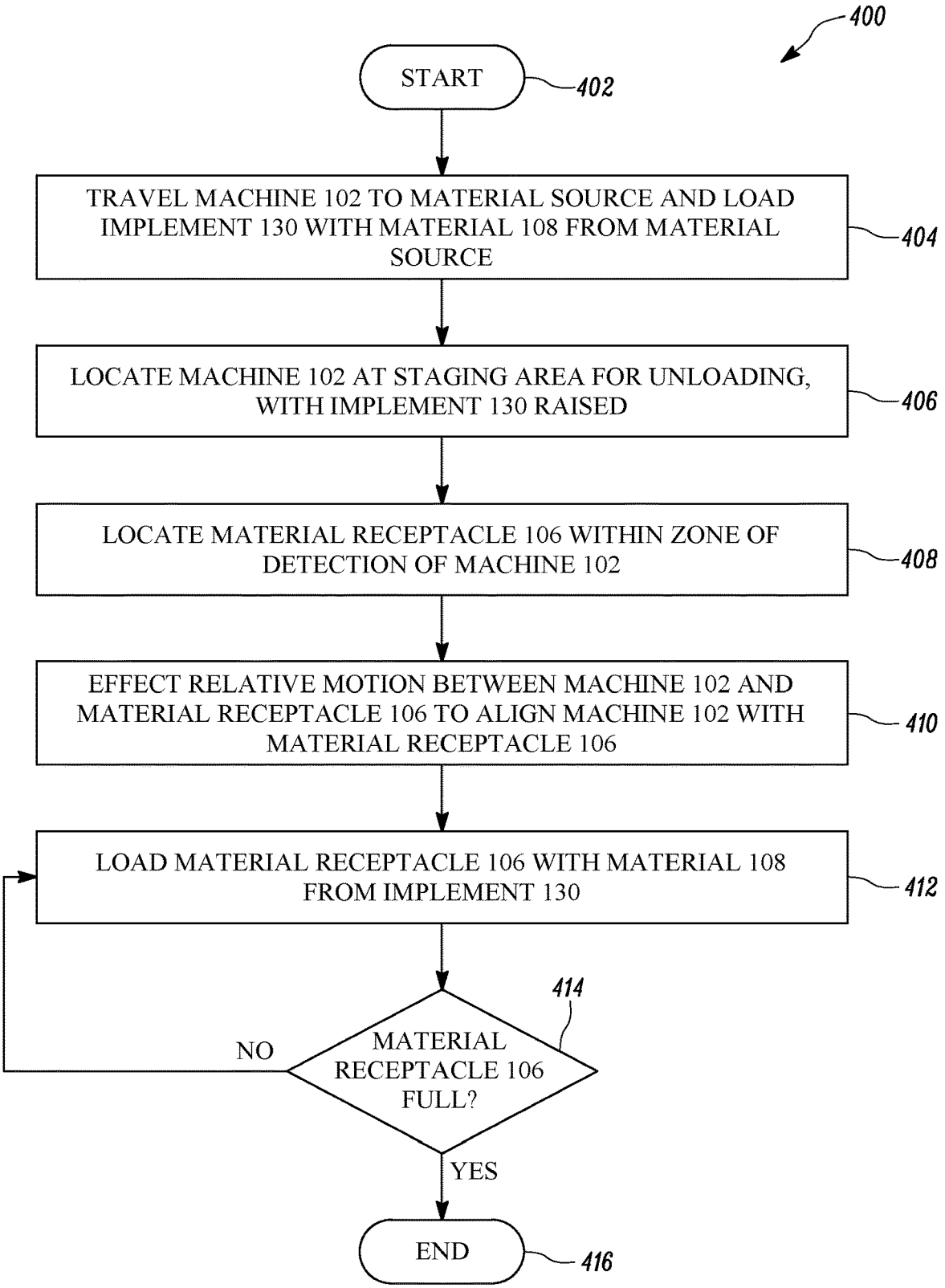
FIG. 4 is a flowchart of a method for transferring a material from a material source to a material receptacle using a material-handling machine, according to an aspect of the disclosure.

FIG. 4 is a flowchart of a method 400 for transferring a material 108 from a material source to a material receptacle 106 using a material-handling machine 102, according to an aspect of the disclosure. From the start 402, the method 400 proceeds to step 404 where the machine 102 travels to a material source and loads its implement 130 with material 108 from the material source.

Next, in step 406, the machine 102 is located in a staging area in preparation for unloading material 108 from its implement 130 into a material receptacle 106. In the case of a material receptacle 106 that is stationary with respect to the work surface 104, the staging area may be an area that locates the implement 130 relative to the material receptacle 106 within less than about an overall length of the machine 102 along the forward direction 152. Alternatively, the staging area may be an area that locates the material receptacle 106 within the zone of detection 208 of the perception system 120.

In the case of a mobile material receptacle 106, such as the bed of a dump truck 110, that has not yet reached its loading location, the staging area may be an area that locates the implement 130 within less than about an overall length of the machine 102, along the forward direction 152, within an anticipated loading location for the material receptacle 106. The implement 130 may be raised from a carrying height to an approximate unloading height by actuating the lift actuator 138, while the operator of the machine 102 waits for the material receptacle 106 to travel to the loading location.

In step 408 the material receptacle 106 is located within the zone of detection 208 of the perception system 120, and the controller 196 may proceed to locate features of the material receptacle 106 relative to the implement 130 or other portion of the machine 102 based on input from the perception system 120.

In step 410, relative motion between the machine 102 and the material receptacle is effected to align the machine 102 with the material receptacle 106 in a way that facilitates transfer of the material 108 from the implement 130 to the material receptacle. The relative motion between the machine 102 and the material receptacle 106 may be effected by moving the machine 102 relative to the work surface 104, moving the receptacle 106 relative to the work surface 104, or combinations thereof.

According to an aspect of the disclosure, the machine 102 may be a wheel loader, and the relative motion between the wheel loader and the material receptacle 106 may be effected by operating the propulsion system 116 of the wheel loader, the implement system 118 of the wheel loader, or both, to move the implement 130 relative to the work surface 104. According to another aspect of the disclosure, the machine 102 may be an excavator having a body 112 that is fixed stationary with respect to the work surface, perhaps fixed by outriggers engaged with the work surface 104, and the relative motion between the excavator and the material receptacle 106 may be effected by operating the implement system 118 of the excavator (perhaps including boom, stick, and swing actuators) to move the implement 130 relative to the work surface 104.

Next, in step 412, the material receptacle 106 is loaded with material 108 by transferring the material 108 from the implement 130 of the machine 102 to the material receptacle 106.

Optionally, in step 414, the operator or the controller 196 determines whether the material receptacle 106 is full. If the material receptacle 106 is full, then the method 400 may proceed to the end at step 416. Else, if the material receptacle 106 is not full, then the method 400 may return to step 412 for additional material 108 loading. The controller 196 may determine whether the material receptacle 106 is full by counting a number material loading and unloading cycles performed with that particular receptacle 106 via the cycle counter unit 204, and by comparing the number of material loading and unloading cycles to a capacity of the material receptacle 106.

Figure 5:
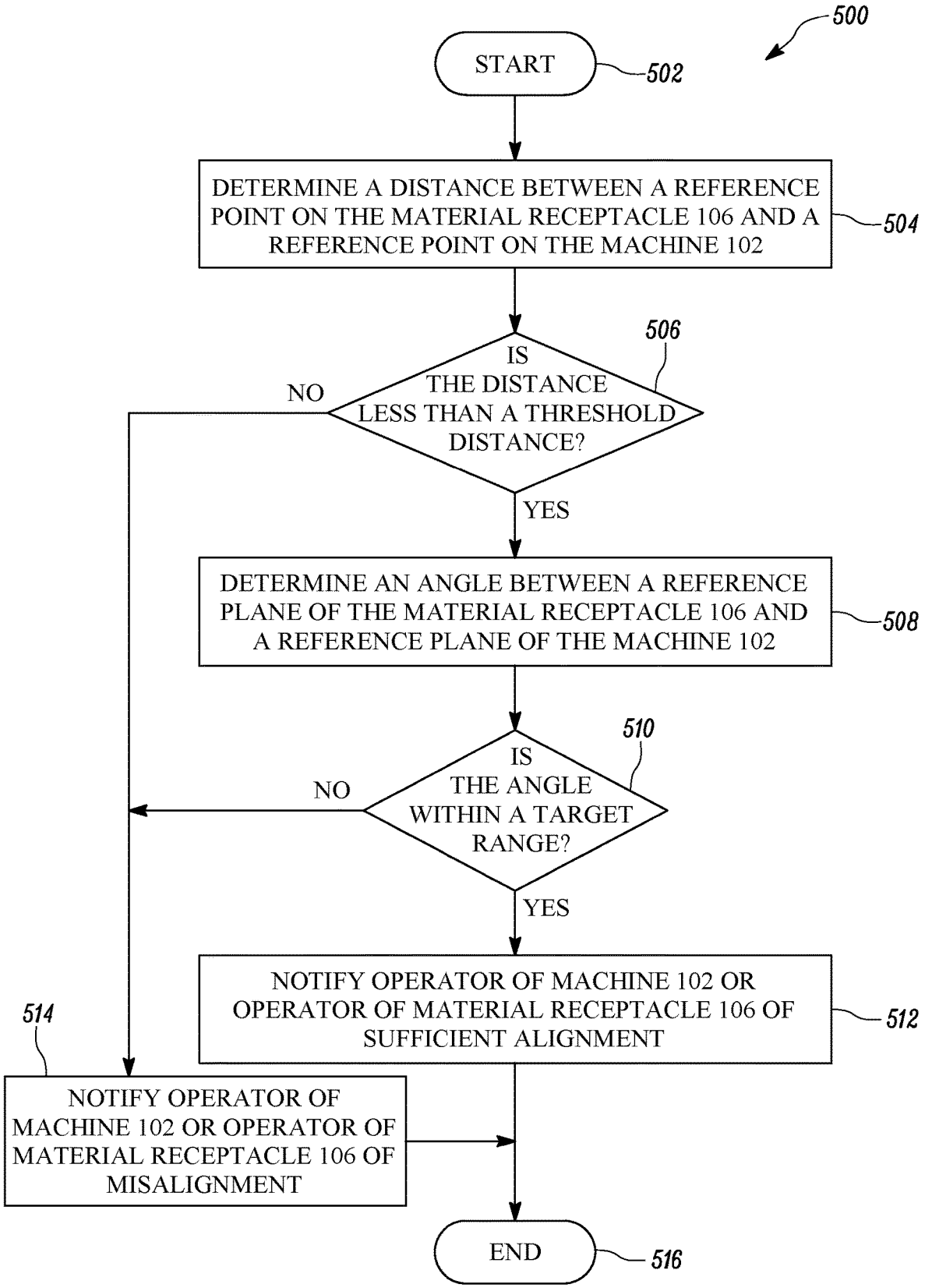
FIG. 5 is a flowchart of a method for aligning a material-handling machine with a material receptacle, according to an aspect of the disclosure.

FIG. 5 is a flowchart of a method 500 for checking alignment of a machine 102 with a material receptacle 106, according to an aspect of the disclosure. As discussed previously with respect to step 410 of method 400, relative motion may be effected between the machine 102 and a receptacle 106 to align the machine 102 with the receptacle 106. And now, the following functions may be performed by the controller 196 to check for adequate alignment between the machine 102 and the material receptacle 106.

From the start 502, the method 500 proceeds to step 504, where the controller 196 determines a distance between a reference point of the material receptacle 106 and a reference point of the machine 102 based on input from the perception system 120. Non-limiting examples of the reference point on the material receptacle 106 include a point on the left edge 168 of the material receptacle 106 or a point on the right edge 174 of the material receptacle 106. Non-limiting examples of the reference point of the machine 102 include the left edge 172 of the implement 130 and the right edge 178 of the implement 130 (see FIG. 2). Non-limiting examples of the distance between the reference point on the material receptacle 106 and the reference point on the machine 102 include the distance 170 and the distance 176, illustrated in FIG. 2. However, it will be appreciated that other reference points may be defined on the machine 102, the material receptacle 106, or both, to suit a particular application.

Next, in step 506, the controller 196 determines whether the distance between the reference point on the material receptacle 106 and the machine 102 is less than a threshold distance. The threshold distance may be selected to ensure sufficient alignment along the transverse direction 156 to avoid spilling material 108 from the implement 130 to outside the material receptacle 106, thereby diminishing productivity of the material transfer. Alternatively or additionally, the reference distance may be selected to promote a desired material 108 distribution within the material receptacle 106.

If the distance is less than the threshold distance in step 506, the method 500 may proceed to step 508, where the controller 196 determines an angle between a reference plane of the material receptacle 106 and a reference plane of the machine 102. Referring to FIG. 2, the reference plane of the machine 102 may be the reference plane 184, and the reference plane of the material receptacle 106 may be the reference plane 186. However, it will be appreciated that other reference planes may be defined for the machine 102, the material receptacle 106, or both, to suit a particular application.

Next, in step 510, the controller 196 may determine whether the angle determined in step 508 is within a target range. The angle target range may be defined based on geometries of the machine 102, the material receptacle 106, or both, to ensure that the implement 130 may be able to unload material 108 into the material receptacle 106 without having unintended contact between the machine 102 and the material receptacle 106. For the reference planes 184 and 186 illustrated in FIG. 2, the angle target range may include 90 degrees.

If the angle is within the target range in step 510, the method 500 may proceed to step 512 where the controller 196 generates and transmits a control command signal to notify the operator of the machine 102, an operator of the material receptacle 106, or both, that the machine 102 and the material receptacle 106 are sufficiently aligned to proceed with unloading material 108 from the implement 130 to the material receptacle 106. As discussed in more detail below, given sufficient alignment of the machine 102 with the material receptacle 106, unloading of material 108 from the implement 130 to the material receptacle may proceed under manual control of the machine 102 operator, manual control inputs from the operator of the machine 102 that are either overridden or modified by the controller 196, or under completely automatic control of the controller 196.

If the distance is not less than a threshold distance in step 506, or if the angle is not within the target range in step 510, the method 500 may proceed to step 514 where the controller 196 generates and transmits a control command signal to notify the operator of the machine 102, an operator of the material receptacle 106, or both, that the machine 102 and the material receptacle 106 are not sufficiently aligned to proceed with unloading material 108 from the implement 130 to the material receptacle 106. If the machine 102 and the material receptacle 106 are not sufficiently aligned, then the operator of the material receptacle 106 may move the material receptacle 106 relative to the work surface 104 to attempt to effect sufficient alignment with the machine 102. Alternatively or additionally, the material receptacle 106 may remain stationary with respect to the work surface 104, and the operator of the machine 102 may operate the propulsion system 116, the implement system 118, or both of the machine 102 to manually align the machine 102 with the material receptacle 106 and then unload material 108 from the implement 130 to the material receptacle 106.

The notification in either of steps 512 or 514 may be an audible notification, a visual notification, combinations thereof, or any other notification form known in the art. For example, the controller 196 may cause a horn of the machine 102 to honk to notify an operator of the material receptacle 106 of alignment in step 512. Alternatively or additionally, a visual or audible indicator may be triggered within an operator cab of the machine 102, the material receptacle 106, or both, as part of steps 512 or 514.

From either step 512 or step 514, the method 500 ends at step 516. However, it will be appreciated that other methods or functions may precede, follow, or be interspersed with the steps expressly outlined in method 500.

Figure 6:
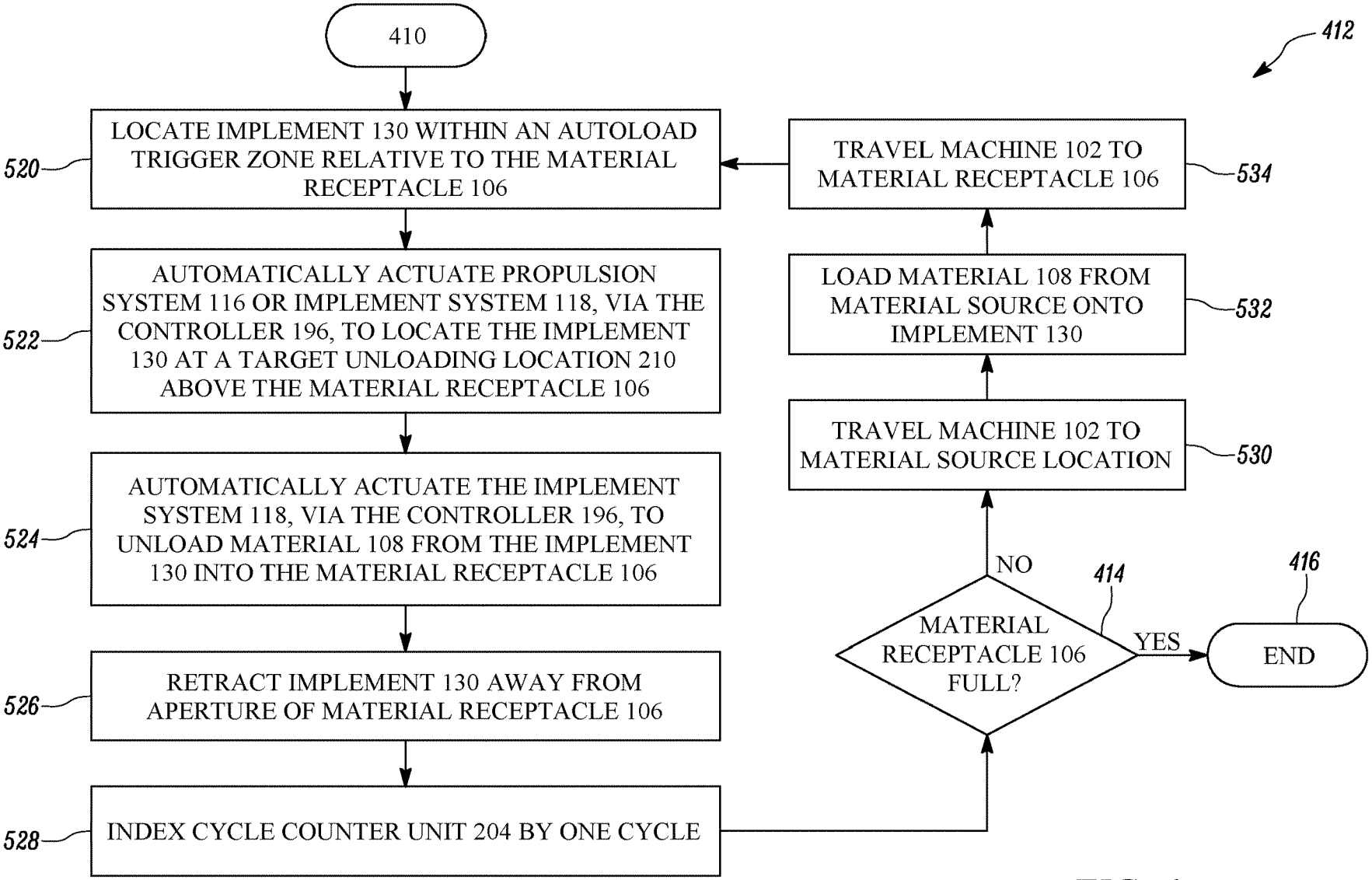
FIG. 6 is a flowchart of a method for loading a material receptacle with material from an implement of a material-handling machine, according to an aspect of the disclosure.

FIG. 6 shows a flowchart of a method 412 for loading a material receptacle 106 with a material 108 from an implement 130, according to an aspect of the disclosure. Following step 410 of method 400 (FIG. 4), the method 412 proceeds to step 520 where the implement 130 is located in an autoload trigger zone of the material receptacle 106.

Figure 7A:
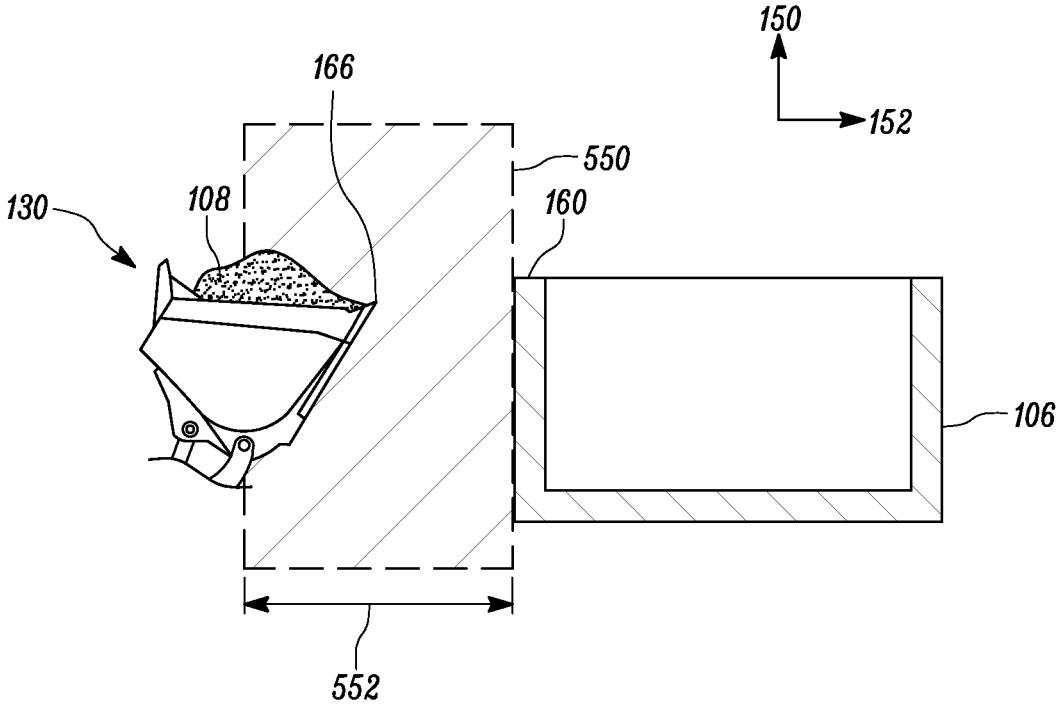
FIGS. 7A, 7B, and 7C are side views of an operation for loading a material receptacle with material from an implement of a material-handling machine, according to an aspect of the disclosure.

As shown in FIG. 7A, an autoload trigger zone 550 may be defined adjacent to the material receptacle 106. A width 552 of the autoload trigger zone 550 may extend away from the material receptacle 106 and toward the machine 102 along the forward direction 152, and a height of the autoload trigger zone 550 may extend from below the top edge 160 of the material receptacle 106 to above the top edge 160 of the material receptacle 106, along the vertical direction 150. FIG. 7A shows the leading edge 166 of the implement 130 disposed within the autoload trigger zone 550.

According to an aspect of the disclosure, the width 552 of the autoload trigger zone 550 is less than an overall length of the machine 102 along the forward direction 152. According to another aspect of the disclosure, the height of the autoload trigger zone 550 extends from below the material receptacle 106 to above the material receptacle 106 along the vertical direction 150.

Upon detecting that the implement 130 is disposed within the autoload trigger zone 550, the controller 196 may generate and transmit a control signal that notifies the operator of the machine 102 that the implement 130 is disposed within the autoload trigger zone 550. The notification of the operator may take the form of a visual notification on a display of the machine 102, an audible notification generated within the operator cab 192, combinations thereof, or any other form of operator notification known in the art.

According to an aspect of the disclosure, the controller 196 may wait for an additional command control signal from the operator, after identifying that the implement 130 is located within the autoload trigger zone 550, before initiating an automatic procedure to unload material 108 from the implement 130 that begins with step 522. According to another aspect of the disclosure, the controller 196 may automatically initiate an automatic unloading procedure, which begins with step 522, upon identifying that the implement 130 is located within the autoload trigger zone 550, without further input from the operator.

In step 522, the controller automatically actuates the propulsion system 116, the implement system 118, or both, to locate the implement 130 at a target unloading location above the material receptacle 106. It will be appreciated that the alignment verification method 500 (see FIG. 5) may optionally be performed between step 520 and step 522.

Figure 7B:
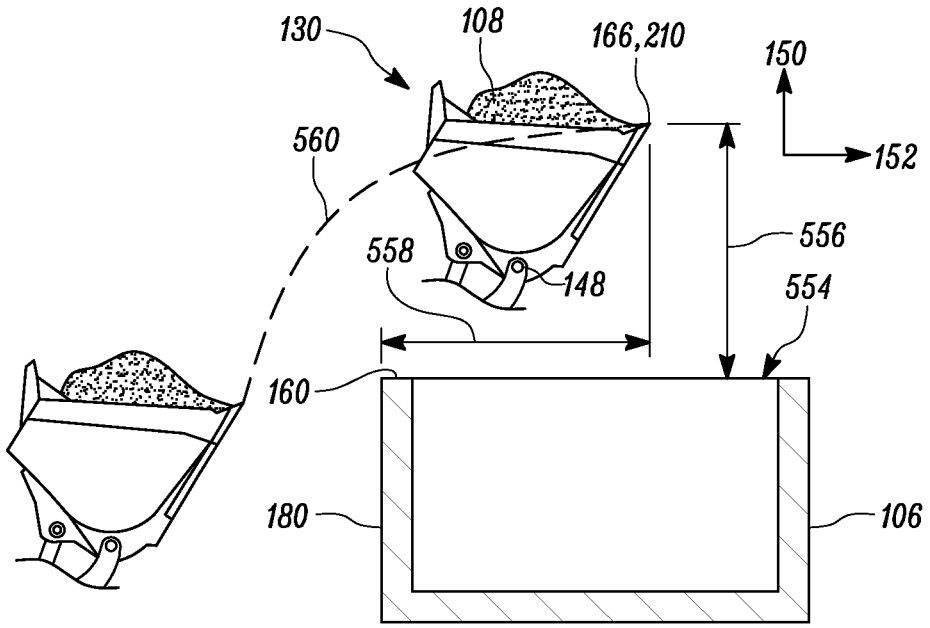

As shown in FIG. 7B, the controller 196 actuates the machine 102 to automatically move the implement 130 along a predetermined path 560 to locate the leading edge 166 of the implement 130 at a target unloading location 210 above an aperture 554 of the material receptacle 106. The predetermined path 560 is selected to locate the implement 130 at the target unloading location 210 while avoiding any unintended contact between the machine 102 and the material receptacle 106. Further, the controller 196 may actuate the propulsion system 116, the implement system 118, or both, to effect motion of the implement 130 along the predetermined path 560.

The target unloading location 210 may be disposed a vertical distance 556 above the top edge 160 of the material receptacle along the vertical direction 150, and a horizontal distance 558 from the proximate wall 180 (see FIG. 2) of the material receptacle 106. The vertical distance 556 may be selected to avoid unintended contact between the machine 102 and the material receptacle 106, avoid unintended contact between the machine 102 and material 108 previously delivered to the material receptacle 106, minimize a vertical drop distance of material 108 from the implement 130 to the material receptacle 106, avoid contact between the machine 102 and material 108 previously unloaded into the material receptacle 106, combinations thereof, or any other considerations relevant to a particular material-handling application.

According to an aspect of the disclosure, selection of the vertical distance 556 may be based at least in part upon a variance or roughness of the work surface 104 along the vertical direction 150, to provide sufficient margin to avoid unintended contact between the machine 102 and the material receptacle 106. For example, an operator may want more vertical margin between the target unloading location 210 and the material receptacle 106 for rougher work surface 104 conditions. According to another aspect of the disclosure, the controller 196 may be configured to determine a variance or roughness of the work surface 104 along the vertical direction 150 from data collected from the perception system 120, and then use the variance or roughness of the work surface 104 as part of an algorithm for determining the vertical distance 556.

The horizontal distance 558 may be selected to avoid unintended contact between the implement 130 and the material receptacle 106 during the unloading of material 108 from the implement 130 to the material receptacle 106. According to an aspect of the disclosure, the horizontal distance 558 may be selected to locate the third pivot joint 148 above the aperture 554 of the material receptacle 106.

Figure 7C:
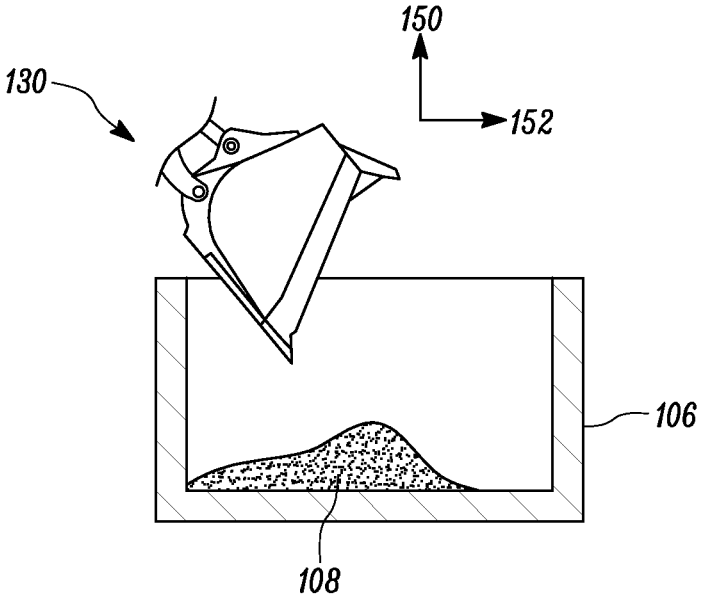

Returning to FIG. 6, in step 524 the controller 196 may automatically actuate the implement system 118 to unload material 108 from the implement 130 into the material receptacle 106. FIG. 7C shows an example of the position of the implement 130 over the material receptacle 106 after unloading material 108 from the implement 130 into the material receptacle 106. According to an aspect of the disclosure, the machine 102 is a wheel loader and the controller 196 may unload material 108 from the implement 130 by only actuating the tilt actuator 142.

Returning to FIG. 6, in step 526 the implement 130 is retracted away from the aperture 554 of the material receptacle 106 along a path that avoids unintended contact between the machine 102 and the material receptacle 106. According to an aspect of the disclosure, the controller 196 is programmed to effect a path in retraction from the material receptacle 106 that is substantially the reverse of the implement 130 path effected in steps 522 and 524.

During any one of steps 520, 522, and 524, the controller 196 may be configured to store a location of the material receptacle 106, in the reference frame of the work surface 104, in memory 200 based on data input from the perception system 120. Additionally, the controller 196 may be configured to store the shape, the size, the three-dimensional geometry, or combinations thereof, of the material receptacle 106 in memory 200, which may help mitigate the effect of measurement variances with respect to the determined location of the material receptacle 106 relative to the work surface 104 or the machine 102.

Next, in step 528, the controller 196 may detect the end of a loading and unloading cycle and index the cycle counter unit 204 by one cycle. According to an aspect of the disclosure, the controller 196 may be configured to vary the vertical distance 556, the horizontal distance 558, or both, as a function of the number of unloading cycles delivered to the material receptacle 106 to achieve a target distribution of material 108 within the material receptacle 106, to compensate for increasing height of material 108 within the material receptacle 106 with successive cycles, or combinations thereof. For example, the controller 196 may be configured to increase the vertical distance 556 with increasing count value from the cycle counter unit 204 that is associated with an operation to fill a particular material receptacle 106 to avoid contact between the implement 130 and material 108 previously unloaded into the material receptacle 106. Alternatively or additionally, the controller 196 may be configured to alternate the horizontal distance 558 between a larger value and a smaller value with increasing count value from the cycle counter unit 204 to promote a desired distribution of material 108 within the material receptacle 106 along the forward direction 152.

If the material receptacle 106 is determined not to be full, then the method 412 may proceed to step 530, where the machine 102 travels to a source of material 108, and then loads material 108 from the source to the implement in step 532. During step 532, the controller 196 may store a location of the material source, in the reference frame of the work surface 104, in memory 200 using data collected from the perception system 120. Then, using stored locations for the material source and the material receptacle 106, the controller 196 may be configured to estimate a time of travel, a distance of travel, or both, between the material source and the material receptacle 106.

Next, in step 534, the machine 102 may return to the material receptacle 106 to begin unloading the material 108 from the implement 130 into the material receptacle 106 beginning with step 520. It will be appreciated that the steps 530, 532, and 534 may be performed with the machine 102 being operated in a purely manual mode, the machine 102 being operated in an automatic mode, the machine 102 being operated in a manual mode with override assistance from the controller 196, or combinations thereof.

Figure 8:
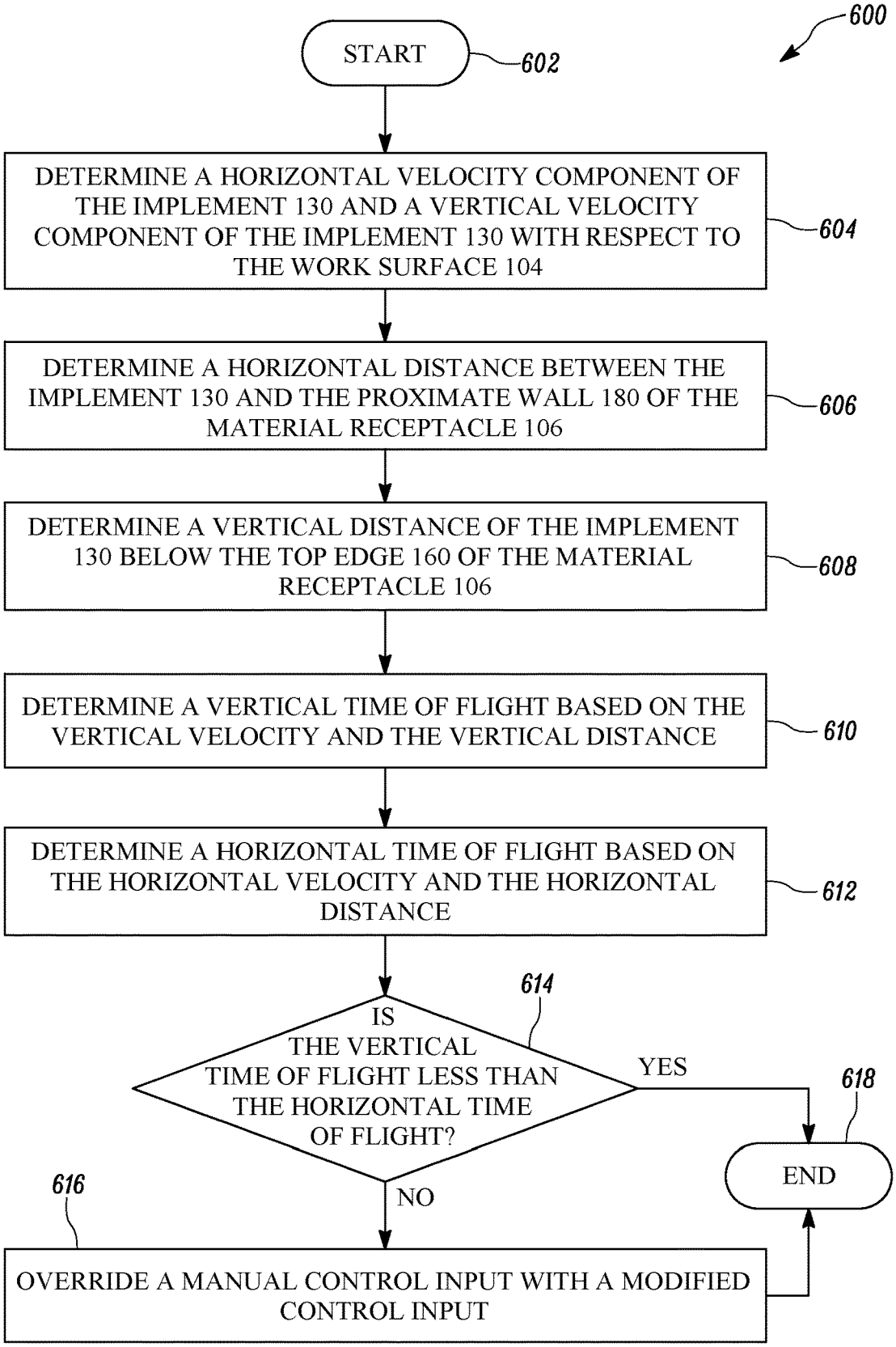
FIG. 8 is a flowchart of a method for a manual mode of unloading an implement of a material-handling machine with override assistance from the controller, according to an aspect of the disclosure.

FIG. 8 shows a flowchart of a method 600 for a manual mode of unloading an implement 130 of a material-handling machine 102 with override assistance from the controller 196, according to an aspect of the disclosure. According to the method 600, a controller 196 may be configured to predict possible or imminent contact between the machine 102 and a material receptacle 106, and then override or modify manual inputs from an operator of the machine 102 to avoid contact between the machine 102 and the material receptacle 106. It will be appreciated that the method 600 may be combined with or incorporated into the method step 412 (see FIG. 4) for any operations in the vicinity of the material receptacle 106 that are not already fully automated within the controller 196.

Figure 9:
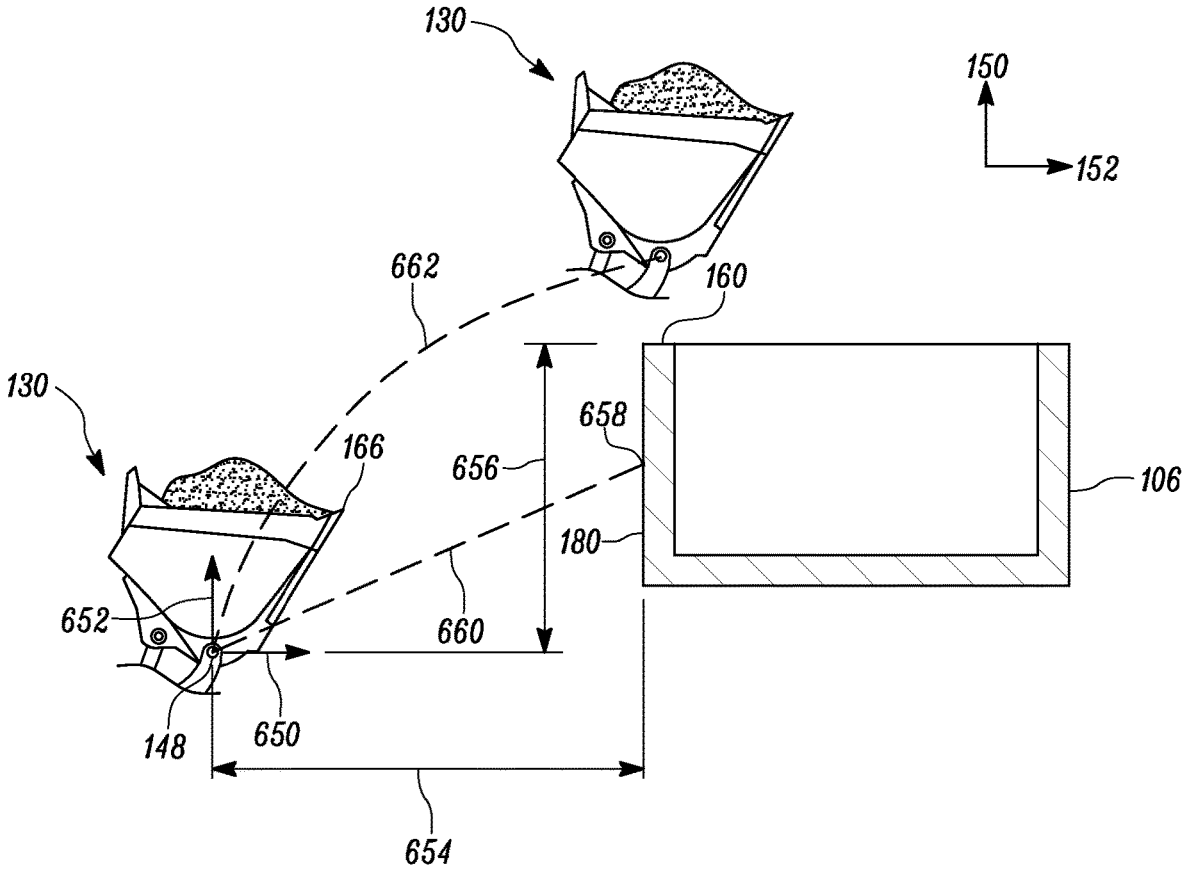
FIG. 9 is a side view of an operation for a manual mode of unloading an implement of a material-handling machine with override assistance from the controller, according to an aspect of the disclosure.

After the start at step 602, the method 600 proceeds to step 604 where a horizontal velocity component of the implement 130 and a vertical velocity component of the implement 130 are determined in a reference frame of the work surface 104. For example, as shown in FIG. 9, the controller 196 may determine a horizontal velocity component 650 of the implement 130 along the forward direction 152, and a vertical velocity component 652 of the implement 130 along the vertical direction 150. It will be appreciated that the velocity of the implement 130 may be determined as a superposition of a velocity of the body 112 of the machine 102 with respect to the work surface 104 (perhaps resulting from operation of the propulsion system 116) with a velocity of the implement 130 with respect to the body 112 of the machine (perhaps resulting from operation of the implement system 118).

Returning to FIG. 8, in step 606 a horizontal distance between the implement 130 and the proximate wall 180 of the material receptacle 106 is determined, and in step 608 a vertical distance of the implement 130 below the top edge 160 of the material receptacle 106 is determined based at least in part on input from the perception system 120. For example, as shown in FIG. 9, the controller 196 may determine a horizontal distance 654 between the third pivot joint 148 and the proximate wall 180 of the material receptacle 106, and a vertical distance 656 between the third pivot joint 148 and the top edge 160 of the material receptacle 106. Although the horizontal distance 654 and the vertical distance 656 are shown with respect to the third pivot joint of the implement 130, it will be appreciated that these distances may be evaluated based on other reference points on the implement 130. For example, in some situations, it may be instructive to calculate the horizontal and vertical distances from the leading edge 166 of the implement 130. It will also be appreciated that the controller 196 may simultaneously consider more than one reference point on the implement 130 to better avoid unintended contact between the machine 102 and the material receptacle 106.

Returning to FIG. 8, in step 610 a vertical time of flight based on the vertical velocity and the vertical distance is calculated. It will be appreciated that the vertical time of flight may be calculated by dividing the vertical distance determined in step 608 by the vertical velocity determined in step 604. In step 612 a horizontal time of flight based on the horizontal velocity and the vertical distance is calculated. It will be appreciated that the horizontal time of flight may be calculated by dividing the horizontal distance determined in step 606 by the horizontal velocity determined in step 604.

In step 614, the vertical time of flight is compared to the horizontal time of flight. If the vertical time of flight is less than the horizontal time of flight, then there is no predicted or imminent contact between the implement 130 and the material receptacle 106, and the method 600 proceeds to the end at step 618 because no control signal intervention is required by the controller 196 to avoid contact between the implement 130 and the material receptacle 106.

However, if the vertical time of flight is not less than the horizontal time of flight, then there is predicted or imminent contact between the implement 130 and the material receptacle 106, and the method 600 proceeds to step 616, where the controller 196 overrides or modifies the operator's manual control command signals to better avoid contact between the implement 130 and the material receptacle 106. To avoid the predicted contact, the controller 196 may act to slow the horizontal velocity 650 of the implement 130, increase the vertical velocity component 652 of the implement 130, or combinations thereof.

The controller 196 may act to slow the horizontal velocity 650 of the implement by applying the at least one braking device 128, opening a clutch in the at least one transmission mechanism 124, downshifting to a lower gear in the at least one transmission mechanism 124, reducing an output shaft speed of the power source 122, combinations thereof, or any other method known in the art for reducing the horizontal velocity component of an implement of a machine. Further, the controller 196 may act to increase the vertical velocity 652 of the implement 130 by increasing hydraulic power applied to the lift actuator 138, adjusting a position of the tilt linkage 140 via the tilt actuator 142, combinations thereof, or any other method known in the art for increasing the vertical velocity component of an implement of a machine.

For example, as shown in FIG. 9, a predicted path 660 of the implement 130 indicates an eventual point of contact 658 with the material receptacle 106, because a vertical time of flight to the material receptacle 106 is not less than a horizontal time of flight to the material receptacle 106. However, through action of the controller 196 to override or modify manual control inputs that lead to the predicted contact 658, the actual path 662 of the implement 130 may be adjusted to avoid contact between the implement 130 and the material receptacle 106.

It will be appreciated that the method 600 may be performed repetitively during an unloading cycle of the machine 102. For example, the method 600 may be performed during every clock cycle of the controller 196, or performed during integer multiples of the clock cycle of the controller 196. According to an aspect of the disclosure, the method 600 may be performed at a frequency that is greater than 1 Hertz. Thus, the controller 196 may be configured to continuously correct a predicted path 660 of the implement 130 to avoid unintended contact between the machine 102 and the material receptacle 106.

Figure 10A:
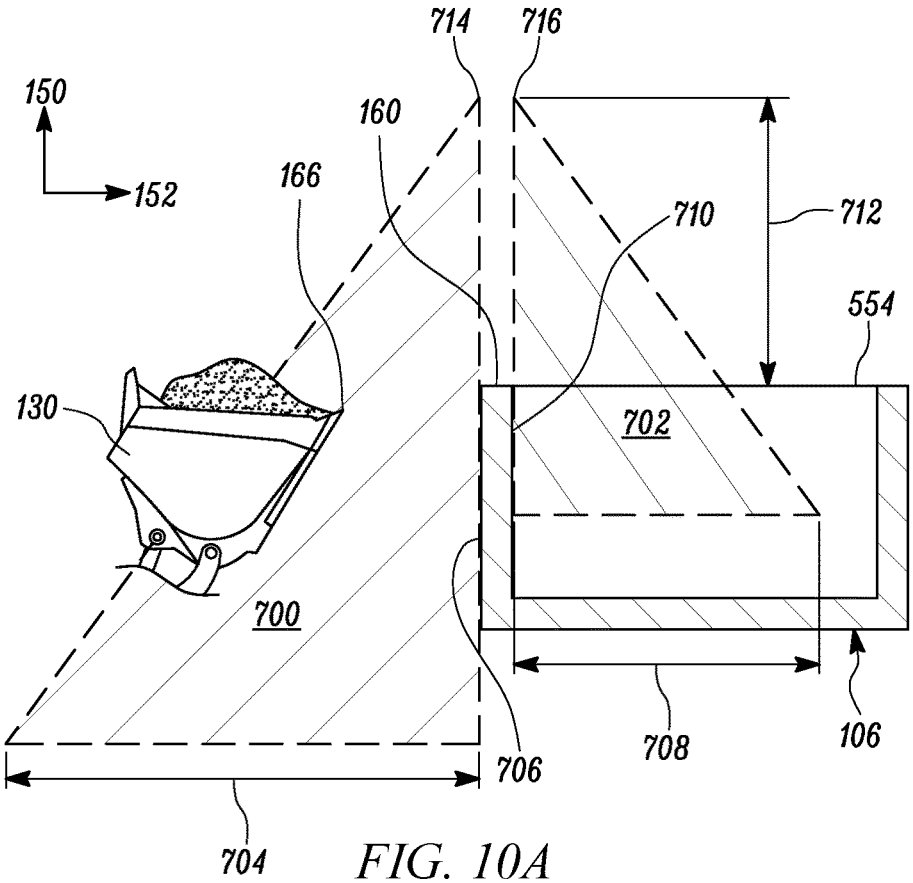
FIGS. 10A and 10B are side views of an operation for a manual mode of unloading an implement of a material-handling machine with override assistance from the controller, according to an aspect of the disclosure.
Figure 10B:
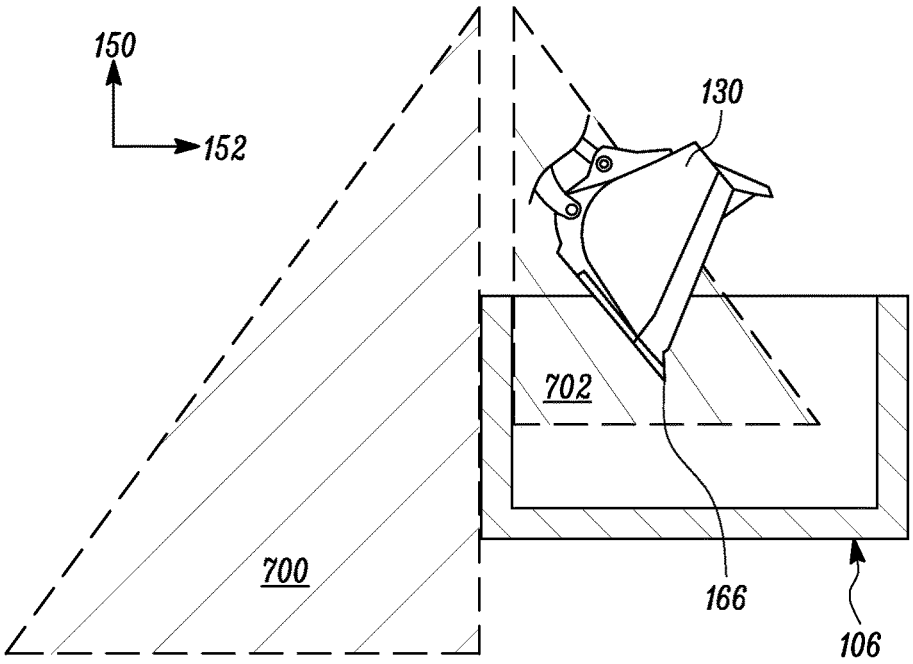

FIGS. 10A and 10B are side views of an operation for a manual mode of unloading an implement of a material-handling machine with override assistance from the controller, according to an aspect of the disclosure. The controller 196 may define a first control override zone 700, a second control override zone 702, or both, relative to the material receptacle 106. Further, the controller 196 may be configured to disable control actions when the leading edge 166 or other point on the implement 130 is disposed within the first control override zone 700 or the second control override zone 702 to better avoid unintentional contact between the machine 102 and the material receptacle 106.

When the leading edge 166 of the implement 130 is disposed within the first control override zone 700, as shown in FIG. 10A, the controller 196 may disable control actions that would cause the leading edge 166 of the implement 130 to move closer to an external surface the material receptacle 106 along the forward direction 152, or that would cause the leading edge 166 of the implement 130 to move downward against the vertical direction 150. For example, when the leading edge 166 of the implement 130 is disposed within the first control override zone 700, the controller 196 may disable the propulsion system 116 from moving the body 112 of the machine 102 toward the material receptacle 106 along the forward direction 152, disable the lift actuator 138 from lowering the lift arm 136 downward against the vertical direction 150, disable the tilt actuator 142 from lowering the leading edge 166 of the implement 130 downward against the vertical direction 150, or combinations thereof. It will be appreciated that disabling the propulsion system 116 from moving the body 112 of the machine 102 toward the material receptacle 106 along the forward direction 152 may include opening a clutch of the at least one transmission mechanism 124, engaging the at least one braking device 128, or combinations thereof.

When the leading edge 166 of the implement 130 is disposed within the second control override zone 702, as shown in FIG. 10B, the controller 196 may disable control actions that would cause the leading edge 166 of the implement 130 to closer to an internal surface of the material receptacle 106 against the forward direction 152, or that would cause the leading edge 166 of the implement 130 to move downward against the vertical direction 150. For example, when the leading edge 166 of the implement 130 is disposed within the second control override zone 702, the controller 196 may disable the propulsion system 116 from moving the body 112 of the machine 102 toward the material receptacle 106 against the forward direction 152, disable the lift actuator 138 from lowering the lift arm 136 downward against the vertical direction 150, disable the tilt actuator 142 from lowering the leading edge 166 of the implement 130 downward against the vertical direction 150, or combinations thereof. It will be appreciated that disabling the propulsion system 116 from moving the body 112 of the machine 102 toward the material receptacle 106 against the forward direction 152 may include opening a clutch of the at least one transmission mechanism 124, engaging the at least one braking device 128, or combinations thereof.

The first control override zone 700 may at least partially overlap with the autoload trigger zone 550 (see FIG. 7A). According to an aspect of the disclosure, the first control override zone 700 may be located completely within the autoload trigger zone 550. According to another aspect of the disclosure, the second control override zone 702 may be disposed at least partly below the aperture 554 of the material receptacle 106 along the vertical direction 150.

The first control override zone 700 may extend a horizontal distance 704 from an external surface 706 of the material receptacle 106 along the forward direction 152, and may extend above and below the top edge 160 of the material receptacle 106 along the vertical direction 150. The second control override zone 702 may extend a horizontal distance 708 from an internal surface 710 of the material receptacle 106 along the forward direction 152, and may extend above and below the top edge 160 of the material receptacle 106 along the vertical direction 150.

The first control override zone 700, the second control override zone 702, or both may extend a vertical distance 712 above the top edge 160 of the material receptacle 106 to better avoid unintentional contact between the implement 130 and the material receptacle 106. The vertical distance 712 may be less than the vertical distance 556 from the top edge 160 of the material receptacle 106 to the target unloading location 210 (see FIG. 7B). Furthermore, the controller 196 may determine the vertical distance 712 based on a variance or roughness of the work surface 104 along the vertical direction 150, a geometry of the implement 130, or both.

A width of the first control override zone 700, the second control override zone 702, or both, may taper down along the vertical direction 150. According to an aspect of the disclosure, a width of the first control override zone 700 may taper down from the horizontal distance 704 to a point 714, which is disposed above the top edge 160 of the material receptacle 106, along the vertical direction 150. According to another aspect of the disclosure, a width of the second control override zone 702 may taper down from the horizontal distance 708 to a point 716, which is disposed above the top edge 160 of the material receptacle 106, along the vertical direction. The first control override zone 700, the second control override zone 702, or both, may have a triangular shape in a plane defined by the vertical direction 150 and the forward direction 152.

It will be appreciated that the controller 196 logic pertaining to the first control override zone 700, the second control override zone 702, or both, may be combined with the method 400 (see FIG. 4), the method step 412 as described in FIG. 6, the method 600 (see FIG. 8), or combinations thereof, to better avoid unintentional contact between the implement 130 and the material receptacle 106.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Any of the methods or functions described herein may be performed by or controlled by the controller 196. Further, any of the methods or functions described herein may be embodied in a computer-readable non-transitory medium for causing the controller 196 to perform the methods or functions described herein. Such computer-readable non-transitory media may include magnetic disks, optical discs, solid state disk drives, combinations thereof, or any other computer-readable non-transitory medium known in the art. Moreover, it will be appreciated that the methods and functions described herein may be incorporated into larger control schemes for an engine, a machine, or combinations thereof, including other methods and functions not described herein, and that any of the methods or method steps described may be combined, either in part or in their entireties, unless specified otherwise.

We claim:

1. A system for controlling a machine, the machine including a power generation system, a propulsion system operatively coupled to the power generation system for transmission of power therebetween and configured to propel the machine over a work surface, and a work implement operatively coupled to the power generation system for transmission of power therebetween and coupled to a body of the machine via a linkage that includes at least one actuator, the system comprising:

a perception system configured to generate a signal that is indicative of a position of the machine relative to a material receptacle; and a controller operatively coupled to the perception system, the propulsion system, the power generation system, and the at least one actuator, the controller being configured to receive the signal from the perception system, determine a location of the work implement relative to the material receptacle based at least in part on the signal from the perception system, determine a horizontal distance from the work implement to the material receptacle along a horizontal direction based on the signal from the perception system, determine a horizontal velocity of the work implement relative to the material receptacle along the horizontal direction based at least in part on the signal from the perception system, determine a vertical distance from the work implement to the material receptacle along a vertical direction based on the signal from the perception system, the vertical direction extending substantially perpendicular to the work surface, the vertical direction being perpendicular to the horizontal direction, determine an instantaneous vertical velocity of the work implement relative to the material receptacle along the vertical direction based at least in part on the signal from the perception system, and actuate at least one of the propulsion system, the power generation system, and the at least one actuator based on the determined location of the work implement relative to the material receptacle, the vertical distance, the horizontal distance, the instantaneous vertical velocity, and the horizontal velocity to transfer a material from the work implement to the material receptacle while avoiding contact between the work implement and the material receptacle.

2. The system of claim 1, wherein the controller is further configured to determine a time to contact between the work implement and the material receptacle based on the horizontal distance and the horizontal velocity, determine a time to raise the work implement above an edge of the material receptacle based on the vertical distance and the instantaneous vertical velocity, and determine that the work implement is on a path of potential contact with the material receptacle when the time to contact between the work implement and the material receptacle is less than the time to raise the work implement above the edge of the material receptacle.

3. The system of claim 2, wherein the controller is further configured to increase the instantanenous vertical velocity by actuating the at least one actuator in response to determining that the work implement is on the path of potential contact with the material receptacle.

4. The system of claim 3, wherein the controller is further configured to decrease the horizontal velocity by actuating at least one of the propulsion system and the power generation system in response to determining that the work implement is on the path of potential contact with the material receptacle.

5. The system of claim 3, wherein the controller is further configured to increase the instantaneous vertical velocity by increasing a flow of hydraulic fluid to the at least one actuator.

6. The system of claim 2, wherein the controller is further configured to decrease the horizontal velocity by actuating at least one of the propulsion system and the power generation system in response to determining that the work implement is on the path of potential contact with the material receptacle.

7. The system of claim 6, wherein the controller is further configured to decrease the horizontal velocity by decreasing a power output of an engine of the machine.

8. The system of claim 6, wherein the controller is further configured to decrease the horizontal velocity by actuating at least one of a service brake of the propulsion system and a clutch of the power generation system.

9. The system of claim 1, wherein the at least one actuator includes a first actuator and a second actuator, and wherein the controller is further configured to actuate at least one of the propulsion system and the first actuator based on the determined location of the work implement relative to the material receptacle to position the work implement in a target location relative to the material receptacle, and actuate the second actuator based on the determined location of the work implement relative to the material receptacle to transfer the material from the work implement to the material receptacle.

10. The system of claim 1, wherein the controller is further configured to override an operator control command to at least one of the propulsion system, the power generation system, and the at least one actuator based on the determined location of the work implement relative to the material receptacle to avoid contact between the work implement and the material receptacle.

11. The system of claim 1, wherein the controller is further configured to actuate at least one of the propulsion system, the power generation system, and the at least one actuator based on the determined location of the work implement relative to the material receptacle, and based on a predefined path of the work implement relative to the material receptacle, to transfer the material from the work implement to the material receptacle while avoiding contact between the work implement and the material receptacle.

12. The system of claim 1, wherein the perception system includes at least one of a monocular camera, a stereo camera, a Light Detection and Ranging (LiDAR) unit, and a Global Positioning System (GPS) unit.

13. The system of claim 1, wherein the controller is further configured to locate a reference point of the machine at a first vertical location with respect to a reference point of the material receptacle, complete a first unloading cycle by transferring a first quantity of material from the work implement to the material receptacle while the reference point of the machine is located at the first vertical location, locate the reference point of the machine at a second vertical location with respect to the reference point of the material receptacle, and complete a second unloading cycle by transferring a second quantity of material from the work implement to the material receptacle while the reference point of the machine is located at the second vertical location, wherein a vertical distance from the first vertical location to the reference point on the material receptacle is less than a vertical distance from the second vertical location to the reference point on the material receptacle.

14. The system of claim 1, wherein the controller is further configured to locate a reference point of the machine at a first horizontal location with respect to a reference point of the material receptacle, complete a first unloading cycle by transferring a first quantity of material from the work implement to the material receptacle while the reference point of the machine is located at the first horizontal location, locate the reference point of the machine at a second horizontal location with respect to the reference point of the material receptacle, and complete a second unloading cycle by transferring a second quantity of material from the work implement to the material receptacle while the reference point of the machine is located at the second horizontal location, wherein a horizontal distance from the first horizontal location to the reference point on the material receptacle is greater than a horizontal distance from the second horizontal location to the reference point on the material receptacle.

15. The system of claim 1, wherein the controller is further configured to store in a memory of the controller a location of the material receptacle relative to the work surface, and at least one of a shape, a size, and a three-dimensional geometry of the material receptacle, and actuate at least one of the propulsion system and the at least one actuator based on the location of the material receptacle and at least one of the shape, the size, and the three-dimensional geometry of the material receptacle, stored in the memory of the controller, to avoid contact between the work implement and the material receptacle.

16. The system of claim 1, wherein the controller is further configured to define an override zone relative to the material receptacle, detect when a point on the machine is within the override zone, and disable at least one of a propulsion function and an implement function of the machine when the point on the machine is detected to be within the override zone and outside the material receptacle.

17. The system of claim 1, wherein the controller is further configured to define an override zone relative to the material receptacle, a width of the override zone along the horizontal direction tapering down with increasing height above the work surface along the vertical direction, detect when a point on the machine is within the override zone, and disable at least one of a propulsion function and an implement function of the machine when the point on the machine is detected to be within the override zone.

18. The system of claim 17, wherein the override zone has a triangular shape in a plane defined by the horizontal direction and the vertical direction.

19. A method for controlling a machine, the machine including a power generation system, a propulsion system operatively coupled to the power generation system for transfer of power therebetween and configured to propel the machine over a work surface, a work implement operatively coupled to the power generation system for transfer of power therebetween and coupled to a body of the machine via a linkage that includes at least one actuator, and a perception system configured to generate a signal that is indicative of a position of the machine relative to a material receptacle, the method comprising:

receiving within a controller the signal from the perception system; determine a location of the work implement relative to the material receptacle based at least in part on the signal from the perception system;

determining a horizontal distance from the work implement to the material receptacle along a horizontal direction based on the signal from the perception system;

determining a horizontal velocity of the work implement relative to the material receptacle along the horizontal direction based at least in part on the signal from the perception system;

determining a vertical distance from the work implement to the material receptacle along a vertical direction based on the signal from the perception system, the vertical direction being perpendicular to the horizontal direction and extending substantially perpendicular to the work surface;

determining, via the controller, an instantaneous vertical velocity of the work implement relative to the material receptacle along the vertical direction based at least in part on the signal from the perception system; and actuating, via the controller, at least one of the propulsion system, the power generation system, and the at least one actuator based on the determined location of the work implement relative to the material receptacle, the vertical distance, the horizontal distance, the instantaneous vertical velocity, and the horizontal velocity to transfer a material from the work implement to the material receptacle while avoiding contact between the work implement and the material receptacle.

20. A machine, comprising:

a power generation system;

a propulsion system operatively coupled to the power generation system for transfer of power therebetween and configured to propel the machine over a work surface;

a work implement operatively coupled to the power generation system for transfer of power therebetween and coupled to a body of the machine via a linkage that includes at least one actuator;

a perception system configured to generate a signal that is indicative of a position of the machine relative to a material receptacle; and a controller operatively coupled to the perception system, the propulsion system, the power generation system, and the at least one actuator, the controller being configured to receive the signal from the perception system, determine a location of the work implement relative to the material receptacle based at least in part on the signal from the perception system, determine a horizontal distance from the work implement to the material receptacle along a horizontal direction based on the signal, from the perception system, determine a horizontal velocity of the work implement relative to the material receptacle along the horizontal direction based at least in part on the signal from the perception system, determine a vertical distance from the work implement to the material receptacle along a vertical direction based on the signal from the perception system, the vertical direction being perpendicular to the horizontal direction and extending substantially perpendicular to the work surface, determine an instantaneous vertical velocity of the work implement relative to the material receptacle along the vertical direction based at least in part on the signal from the perception system, and actuate at least one of the propulsion system, the power generation system, and the at least one actuator based on the determined location of the work implement relative to the material receptacle, the vertical distance, the horizontal distance, the instantaneous vertical velocity, and the horizontal velocity to transfer a material from the work implement to the material receptacle while avoiding contact between the work implement and the material receptacle.

* * * * *